US008103417B2

(12) United States Patent
Gharsalli et al.

(10) Patent No.: US 8,103,417 B2
(45) Date of Patent: Jan. 24, 2012

(54) MACHINE WITH AUTOMATED BLADE POSITIONING SYSTEM

(75) Inventors: Imed Gharsalli, Brimfield, IL (US); Yongliang Zhu, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 1180 days.

(21) Appl. No.: 11/896,393

(22) Filed: Aug. 31, 2007

(65) Prior Publication Data

US 2009/0056961 A1 Mar. 5, 2009

(51) Int. Cl.
*G05D 1/00* (2006.01)

(52) U.S. Cl. ..... 701/50; 318/587

(58) Field of Classification Search ..... 701/50, 701/207, 23–28; 318/587; 172/2–4, 4.5; 37/348, 382, 414–416
See application file for complete search history.

(56) References Cited

U.S. PATENT DOCUMENTS 3,974,699 A 8/1976 Morris et al.
5,107,932 A 4/1992 Zachman et al.
5,764,511 A 6/1998 Henderson
6,295,746 B1 * 10/2001 Meduna et al. ..... 37/382
6,374,153 B1 * 4/2002 Brandt et al. ..... 700/188
6,418,364 B1 * 7/2002 Kalafut et al. ..... 701/50
6,845,311 B1 * 1/2005 Stratton et al. ..... 701/50
7,079,931 B2 7/2006 Sahm et al.
2007/0044980 A1 3/2007 Stratton et al.

* cited by examiner

*Primary Examiner* — Dalena Tran

(74) *Attorney, Agent, or Firm* — Finnegan, Henderson, Farabow, Garrett & Dunner LLP

(57) ABSTRACT

A system is provided for positioning a work implement. The system has at least one actuator for actuating a movement of the work implement. In addition, the system has at least one sensor associated with the at least one actuator and configured to sense at least one parameter indicative of an orientation and a position of the work implement. The system also has at least one ground inclination sensor configured to sense a parameter indicative of an inclination of a surface of the ground. Furthermore, the system has a controller configured to automatically adjust the orientation and position of the work implement in response to data received from the at least one sensor and the at least one ground inclination sensor.

20 Claims, 6 Drawing Sheets

MACHINE WITH AUTOMATED BLADE POSITIONING SYSTEM

TECHNICAL FIELD

The present disclosure is directed to a machine having a blade positioning system, and more particularly, to an automated blade positioning system with slope and elevation control.

BACKGROUND

Motor graders are used primarily as finishing tools to sculpt a surface of a construction site to a final shape and contour. Typically, motor graders include many hand-operated controls to steer the wheels of the grader, position a blade, and articulate the front frame of the grader. The blade is adjustably mounted to the front frame to move relatively small quantities of earth from side to side. In addition, the articulation of the front frame is adjusted by rotating the front frame of the grader relative to the rear frame of the grader.

To produce a final surface contour, the blade and the frame may be adjusted to many different positions. Positioning the blade of a motor grader is a complex and time-consuming task. In particular, operations such as, for example, controlling surface elevations, angles, and cut depths may require a significant portion of the operator's attention. Such demands placed on the operator may cause other tasks necessary for the operation of the motor grader to be neglected.

One way to simplify operator control is to provide autonomous control of the blade. One example is U.S. Pat. No. 5,764,511 issued to Henderson (the '511 patent) on Jun. 9, 1998. The '511 patent discloses a motor grader having a system for automatically controlling the position of a blade. In particular, the motor grader automatically controls the slope of cut relative to a geographic surface. A GPS system and/or a series of sensors are used to determine the relative position of a left bottom edge and a right bottom edge of the blade relative to a desired cutting plane. A controller analyzes the sensed position data and automatically moves the respective edges of the blade to a desired position for creating a particular slope of cut.

Although the system of the '511 patent may autonomously control the slope of cut, operation of the blade may still demand a significant portion of the operator's attention. In particular, the system of the '511 patent may not anticipate cutting-related malfunctions. Furthermore, the system may not automatically take action to prevent such malfunctions. The responsibility of anticipating and preventing such malfunctions may still fall on the operator and may demand such attention, such that other tasks necessary for the operation of the motor grader could be neglected.

The disclosed system is directed to overcoming one or more of the problems set forth above.

SUMMARY OF THE INVENTION

In one aspect, the disclosure is directed toward a work implement positioning system. The system includes at least one actuator for actuating a movement of a work implement. In addition, the system includes at least one sensor associated with the at least one actuator and configured to sense at least one parameter indicative of an orientation and a position of the work implement. The system also includes at least one ground inclination sensor configured to sense a parameter indicative of an inclination of a surface of the ground. The system further includes a controller configured to automatically adjust the orientation and position of the work implement in response to data received from the at least one sensor and the at least one ground inclination sensor.

Consistent with a further aspect of the disclosure, a method is provided for moving and orienting a work implement of a machine. The method includes sensing at least one parameter indicative of an orientation and a position of a work implement. In addition, the method includes sensing at least one parameter indicative of an inclination of the ground. The method further includes automatically modifying the orientation and position of the work implement in response to the sensed orientation and position of the work implement and the inclination of the ground.

DETAILED DESCRIPTION

Figure 1:
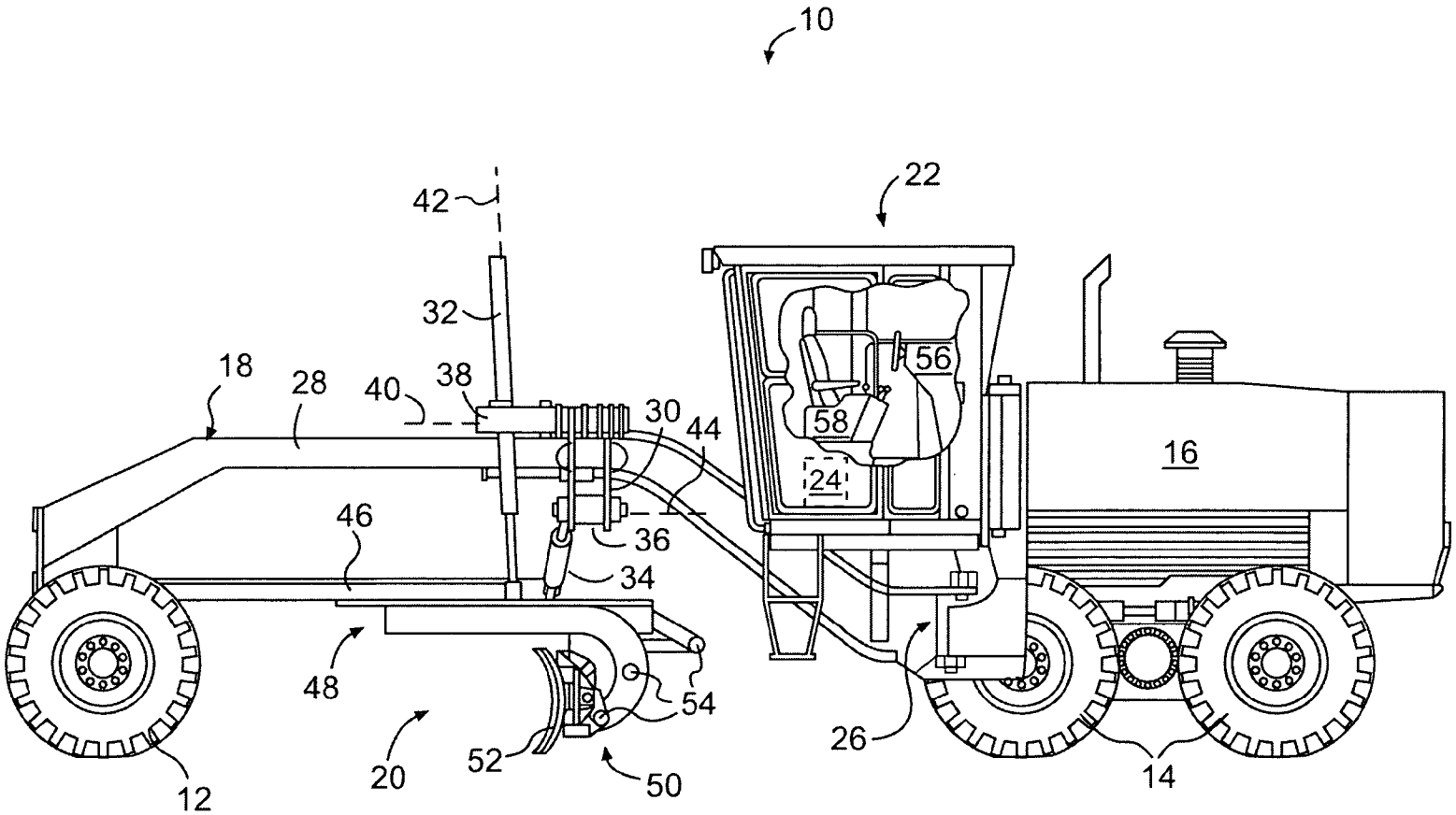
FIG. 1 is a pictorial representation of an exemplary motor grader according to the present disclosure.

An exemplary embodiment of a machine 10 is illustrated in FIG. 1. Machine 10 may be a motor grader, a backhoe loader, an agricultural tractor, a wheel loader, a skid-steer loader, or any other type of machine known in the art. Machine 10 may include a steerable traction device 12, a driven traction device 14, a power source 16 supported by driven traction device 14, and a frame 18 connecting steerable traction device 12 to driven traction device 14. Machine 10 may also include a work implement such as, for example, a drawbar-circle-moldboard assembly (DCM) 20, an operator station 22, and a blade control system 24.

Both steerable and driven traction devices 12, 14 may include one or more wheels located on each side of machine 10 (only one side shown). The wheels may be rotatable and/or tiltable for use during steering and leveling of a work surface (not shown). Alternatively, steerable and/or driven traction devices 12, 14 may include tracks, belts, or other traction devices known in the art. Steerable traction devices 12 may or may not also be driven, while driven traction device 14 may or may not also be steerable. Frame 18 may connect steerable traction device 12 to driven traction device 14 by way of, for example, an articulation joint 26. Furthermore, machine 10 may be caused to articulate steerable traction device 12 relative to driven traction device 14 via articulation joint 26.

Power source 16 may include an engine (not shown) connected to a transmission (not shown). The engine may be, for example, a diesel engine, a gasoline engine, a natural gas engine, or any other engine known in the art. Power source 16 may also be a non-combustion source of power such as a fuel cell, a power storage device, or another source of power known in the art. The transmission may be an electric transmission, a hydraulic transmission, a mechanical transmission, or any other transmission known in the art. The transmission may be operable to produce multiple output speed ratios and may be configured to transfer power from power source 16 to driven traction device 14 at a range of output speeds.

Frame 18 may include an articulation joint 26 that connects driven traction device 14 to frame 18. Machine 10 may be caused to articulate steerable traction device 12 relative to driven traction device 14 via articulation joint 26. Machine 10 may also include a neutral articulation feature that, when activated, causes automatic realignment of steerable traction device 12 relative to driven traction device 14 to cause articulation joint 26 to return to a neutral articulation position.

Frame 18 may also include a beam member 28 that supports a fixedly connected center shift mounting member 30. Beam member 28 may be, for example, a single formed or assembled beam having a substantially hollow square cross-section. The substantially hollow square cross-section may provide frame 18 with a substantially high moment of inertia required to adequately support DCM 20 and center shift mounting member 30. The cross-section of beam member 28 may alternatively be rectangular, round, triangular, or any other appropriate shape.

Center shift mounting member 30 may support a pair of double acting hydraulic rams 32 (only one shown) for affecting vertical movement of DCM 20, a center shift cylinder 34 for affecting horizontal movement of DCM 20, and a link bar 36 adjustable between a plurality of predefined positions. Center shift mounting member 30 may be welded or otherwise fixedly connected to beam member 28 to indirectly support hydraulic rams 32 by way of a pair of bell cranks 38 also known as lift arms. That is, bell cranks 38 may be pivotally connected to center shift mounting member 30 along a horizontal axis 40, while hydraulic rams 32 may be pivotally connected to bell cranks 38 along a vertical axis 42. Each bell crank 38 may further be pivotally connected to link bar 36 along a horizontal axis 44. Center shift cylinder 34 may be similarly pivotally connected to link bar 36.

DCM 20 may include a drawbar member 46 supported by beam member 28 and a ball and socket joint (not shown) located proximal steerable traction device 12. As hydraulic rams 32 and/or center shift cylinder 34 are actuated, DCM 20 may pivot about the ball and socket joint. A circle assembly 48 may be connected to drawbar member 46 via a motor (not shown) to drivingly support a moldboard assembly 50 having a blade 52 and blade positioning cylinders 54. In addition to DCM 20 being both vertically and horizontally positioned relative to beam member 28, DCM 20 may also be controlled to rotate circle and moldboard assemblies 48, 50 relative to drawbar member 46. Blade 52 may be moveable both horizontally and vertically, and oriented relative to circle assembly 48 via blade positioning cylinders 54.

Operator station 22 may embody an area of machine 10 configured to house an operator. Operator station 22 may include a dashboard 56 and an instrument panel 58 containing dials and/or controls for conveying information and for operating machine 10 and its various components.

Figure 2:
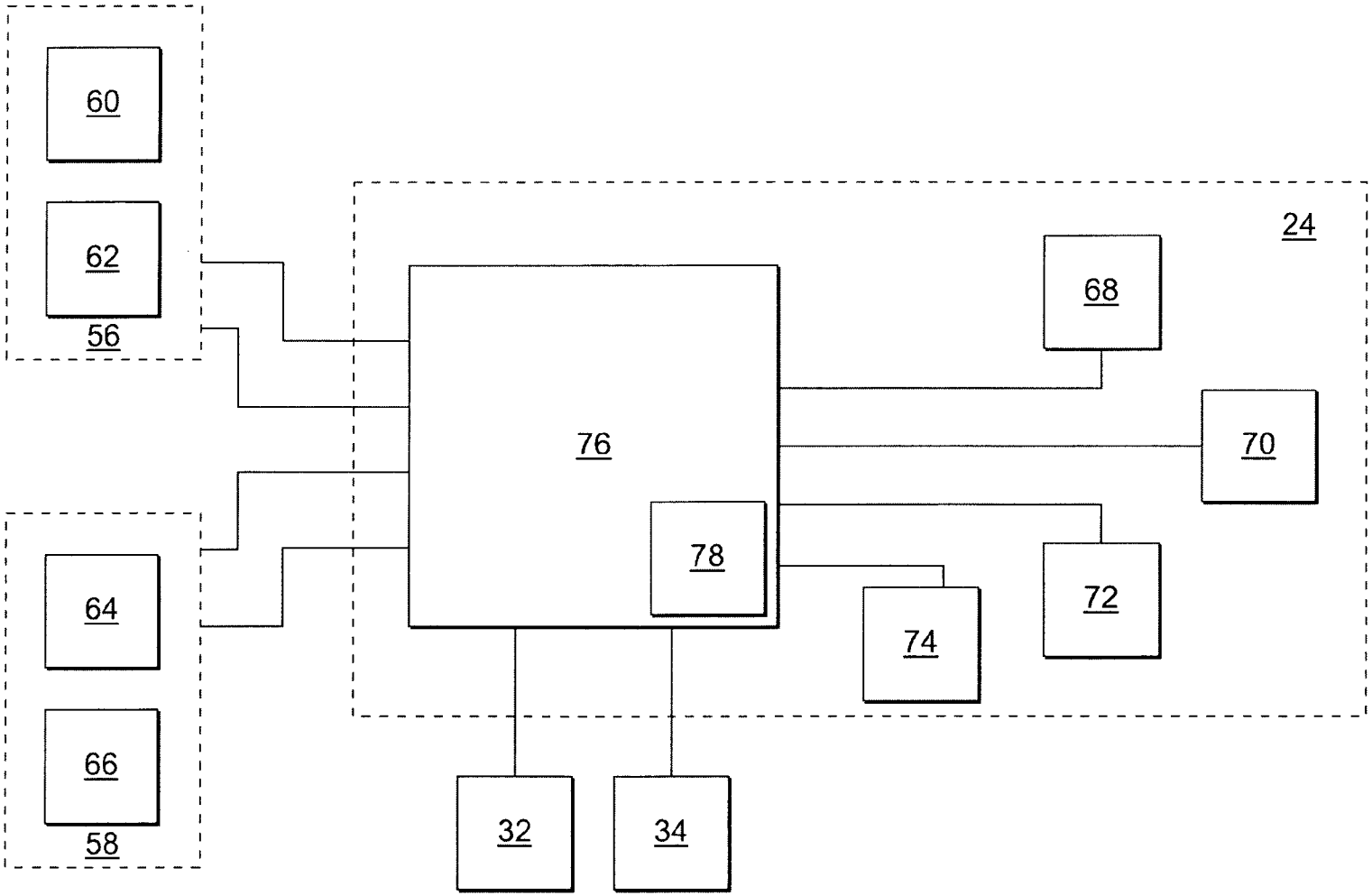
FIG. 2 is a block diagram of an exemplary blade positioning system for the motor grader of FIG. 1.

As illustrated in FIG. 2, dashboard 56 may include a display system 60 and a user interface 62. In addition, instrument panel 58 may include a display system 64 and a user interface 66. Display systems 60 and 64 and user interfaces 62 and 66 may be in communication with blade control system 24. Display systems 60 and 64 may include a computer monitor with an audio speaker, video screen, and/or any other suitable visual display device that conveys information to the operator. It is further contemplated that user interfaces 62 and 66 may include a keyboard, a touch screen, a number pad, a joystick, or any other suitable input device.

Blade control system 24 may move blade 52 to a predetermined position in response to input signals received from user interface 62 and/or 66. Blade control system 24 may include a plurality of cylinder position sensors 68, an articulation sensor 70, a link bar sensor 72, a grade detector 74, and a controller 76. It is contemplated that blade control system may include other sensors, if desired.

Cylinder position sensors 68 may sense the extension and retraction of hydraulic rams 32, center shift cylinder 34, and/or blade positioning cylinders 54. In particular, cylinder position sensors 68 may embody magnetic pickup type sensors associated with magnets (not shown) embedded within the piston assemblies of hydraulic rams 32, center shift cylinder 34, and blade positioning cylinders 54. As hydraulic rams 32, center shift cylinder 34, and blade positioning cylinders 54 extend and retract, cylinder position sensors 68 may provide to blade controller 24 an indication of the position of hydraulic rams 32, center shift cylinder 34, and blade positioning cylinders 54. It is contemplated that cylinder position sensors 68 may alternatively embody other types of position sensors such as, for example, magnetostrictive-type sensors associated with a wave guide internal to hydraulic rams 32, center shift cylinder 34, and blade positioning cylinders 54, cable type sensors associated with cables externally mounted to hydraulic rams 32, center shift cylinder 34, and blade positioning cylinders 54, internally or externally mounted optical type sensors, or any other type of position sensor known in the art. It should be understood that the extension and retraction of the cylinders may be compared with reference look-up maps and/or tables stored in the memory of controller 74 to determine the position and orientation of blade 52.

Articulation sensor 70 may sense the movement and relative position of articulation joint 26 and may be operatively coupled with articulation joint 26. Some examples of suitable articulation sensors 70 include, among others, length potentiometers, radio frequency resonance sensors, rotary potentiometers, machine articulation angle sensors and the like. It should be understood that the movement of articulation joint 26 may be compared with reference look-up maps and/or tables stored in the memory of controller 74 to determine the articulation of machine 10.

Link bar sensor 72 may sense the rotational angle of bell cranks 38 about horizontal axis 40. For example, link bar sensor 72 may embody a magnetic pickup type sensor associated with a magnet (not shown) embedded within a protruding portion of center shift mounting member 30. As bell cranks 38 rotate about horizontal axis 40, link bar sensor 72 may provide an indication of the angular positions of bell cranks 38 to controller 76. The angular positions of bell cranks 38 may be directly related to the alignment of a lock pin (not shown) with a particular one of holes (not shown) in link bar 36. The alignment of the lock pin may be utilized by controller 76 when determining a position and an orientation of blade 52. It is contemplated that link bar sensor 72 may alternatively embody another type of angular position sensor such as, for example, an optical type sensor.

Grade detector 74 may be a dual axis inclinometer associated with machine 10 and may continuously detect an inclination of machine 10 with respect to true horizontal. In one exemplary embodiment, grade detector 74 may be associated with or fixedly connected to a frame of machine 10. It is contemplated, however, that grade detector 74 may be located on any stable surface of machine 10, if desired. Grade detector 74 may detect an incline in any direction, including a forward-aft direction, and responsively generate and send an incline signal to controller 76. It should be noted that although this disclosure describes grade detector 74 as an inclinometer, other grade detectors may be used. For example, in an alternate embodiment, grade detector 74 may include two GPS receivers, with one stationed at each end of the machine 10. By knowing the positional difference of the receivers, the inclination of machine 10 with respect to true horizontal may be calculated.

Controller 76 may actuate hydraulic rams 32 to move blade 52 to a desired position and orientation and may embody a single microprocessor or multiple microprocessors that include a means for positioning blade 52. Numerous commercially available microprocessors can be configured to perform the functions of controller 76. It should be appreciated that controller 76 could readily embody a general machine microprocessor capable of controlling numerous machine functions. Controller 76 may include a memory, a secondary storage device, a processor, and any other components for running an application. Various other circuits may be associated with controller 76 such as power supply circuitry, signal conditioning circuitry, solenoid driver circuitry, and other types of circuitry. In addition, controller 76 may include a time tracking device 78. Time tracking device may be a clock, timer, or any other device known in the art that may be capable of tracking time. It is contemplated that although time tracking device 78 is disclosed being integral to controller 76, time tracking device may be an independent, self-contained device, if desired.

Figure 3:
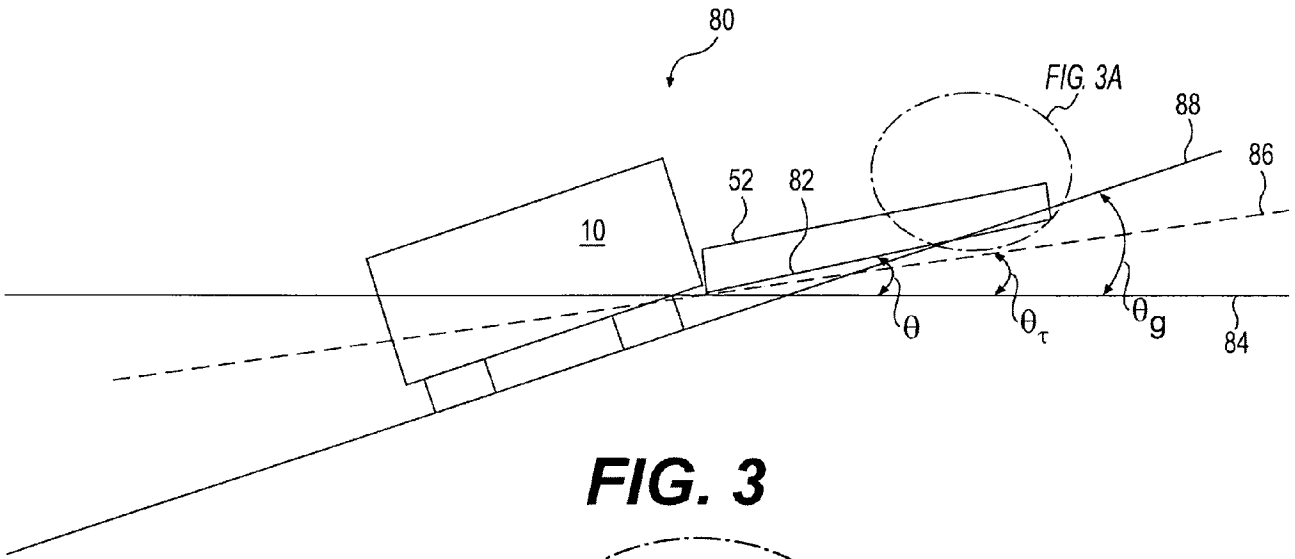
FIG. 3 is a schematic diagram of an exemplary worksite.
Figure 3A:
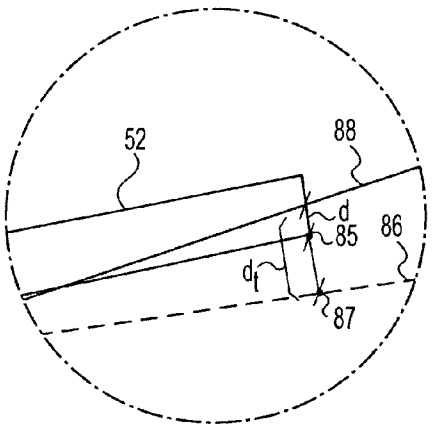
FIG. 3A is another exemplary diagram of the exemplary worksite of FIG. 3.

FIG. 3 illustrates a front view of machine 10 and blade 52 in relation to an exemplary worksite 80 over which machine 10 may traverse. While machine 10 traverses worksite 80, controller 76 may autonomously control and continuously monitor slope angle $\theta$ and cutting depth d of blade 52. Slope angle $\theta$ may pass through a bottom front edge 82 of blade 52 and be defined relative to a plane 84, which may be substantially parallel to true horizontal. In addition, cutting depth d may be a minimum distance between the surface of the ground and a lowest point 85 on blade 52. Slope angle $\theta$ and cutting depth d may be computed based upon signals transmitted by cylinder position sensors 68, articulation sensor 70, link bar sensor 72, and grade detector 74.

Upon receiving the signals from the above-mentioned sensors, controller 76 may compare slope angle $\theta$ and cutting depth d to a target slope angle $\theta_t$ and a target cutting depth $d_t$, respectively. Target slope angle $\theta_t$ and a target cutting depth $d_t$ may be selected by the operator or a high level computer (not shown) and reference algorithms, charts, graphs, and/or tables to determine a proper course of action to achieve and/or maintain target slope angle $\theta_t$ and target cutting depth $d_t$. Such a course of action may include raising and/or lowering left and/or right sides of blade 52 by extending and contracting hydraulic rams 32 by different magnitudes to maintain target slope angle $\theta_t$ and by substantially similar magnitudes to maintain target cutting depth $d_t$. Target slope angle $\theta_t$ may be measured from plane 84 to a target plane 86 substantially parallel to a desired cutting plane of blade 52. In addition, target cutting depth $d_t$ may be a minimum distance between the ground surface and a desired location 87 of lowest point 85. It is contemplated that all other blade positioning operations may be manually performed by the operator or automatically performed by controller 76 or any other controller capable of controlling blade 52. It should be understood that in situations where the position and/or orientation of blade 52 is changed, controller 76 may actuate hydraulic rams 32 to maintain slope angle $\theta$ and cutting depth d of blade 52 at target slope angle $\theta_t$ and target cutting depth $d_t$.

Typically, a target slope angle $\theta_t$ may be selected so that only a portion of blade 52 may penetrate the surface of the ground. If the penetrating portion of blade 52 is too great, power source 16 may become overwhelmed and stall. In some circumstances, the contour of the ground may conflict with target slope angle $\theta_t$. In particular, the contour of the ground may be such that achieving target slope angle $\theta_t$ may cause a great enough portion of blade 52 to penetrate the ground to stall power source 16. To prevent such a malfunction, controller 76 may continuously monitor a ground roll angle $\theta_g$ in addition to slope angle $\theta$ of blade 52. Ground roll angle $\theta_g$ may be measured from plane 84 to a plane 88 that is substantially parallel to a surface of the ground that may come into contact with bottom front edge 82 of blade 52. In addition, ground roll angle $\theta_g$ may be computed based on signals transmitted by grade detector 74. When an absolute value of the difference between ground roll angle $\theta_g$ and target slope $\theta_t$ is greater than a predetermined differential threshold, controller 76 may determine that a potential exists for a malfunction to occur such as, for example, power source 16 stalling. Controller 76 may modify target slope $\theta_t$ to a lesser angle that may allow machine 10 to operate without stalling. It should be understood that the predetermined differential threshold may be a magnitude of an angle, or any other value capable of preventing machine 10 from operating in the above-mentioned situation.

Figure 4:
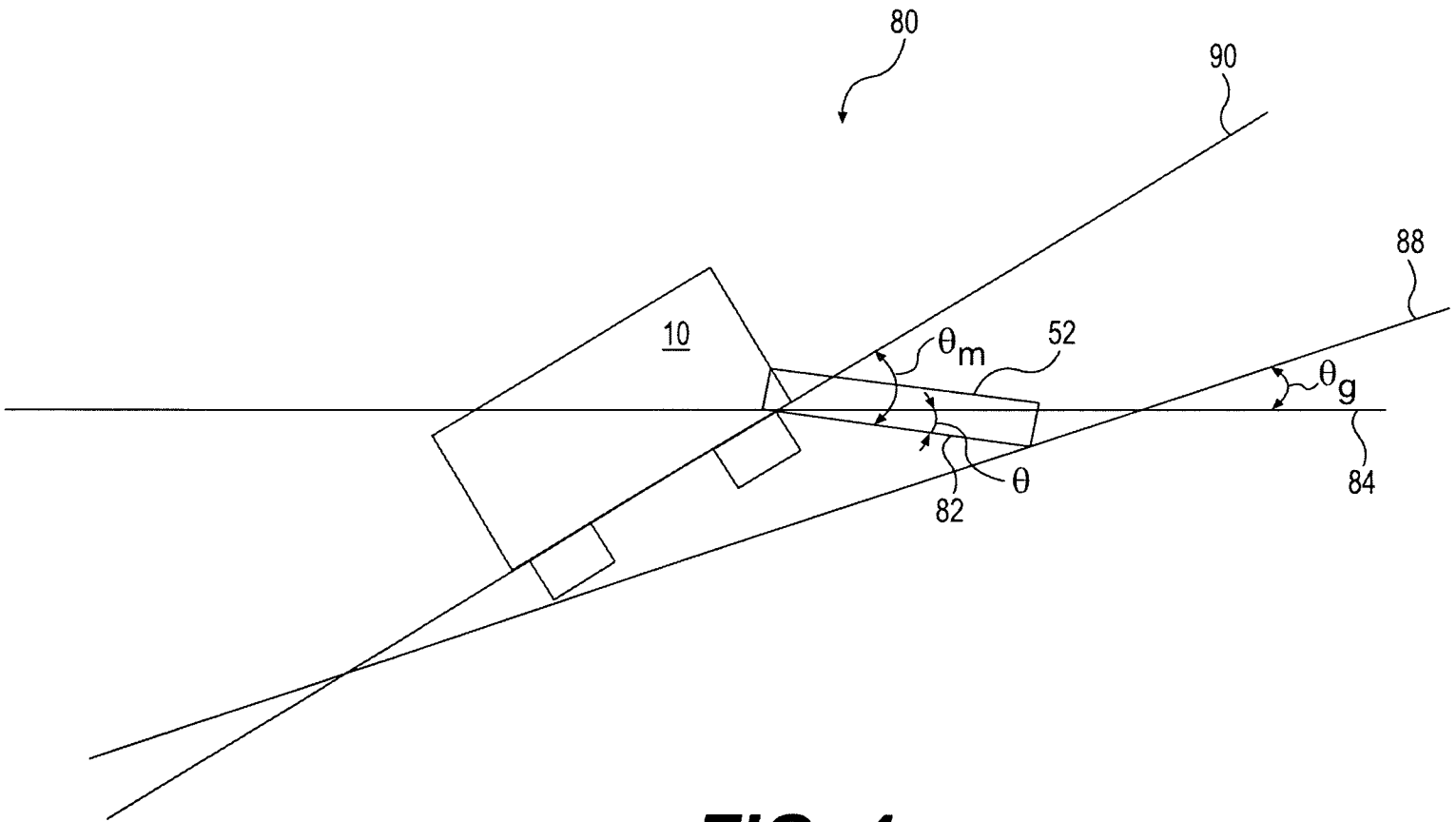
FIG. 4 is a schematic diagram of another exemplary worksite.

In some circumstances, the contour of the ground may increase the likelihood of machine 10 tipping over onto its side during operation and possibly damaging machine 10 or injuring the operator. For example the ground may have a steep inclination conducive to tipping machine 10 over onto its side. Also, the ground may be hard enough to resist penetration by blade 52. As shown in FIG. 4, instead of achieving the desired cutting depth and target slope $\theta_t$, blade 52 may push against the ground and increase a machine roll angle $\theta_m$ of machine 10. The increased machine roll angle $\theta_m$ may raise the likelihood of machine 10 rolling over onto its side. Machine roll angle $\theta_m$ may be measured from a plane 90 substantially parallel to a bottom surface of machine 10 and plane 84. In addition, machine roll angle $\theta_m$ may be computed based on signals transmitted by grade detector 74.

Figure 5:
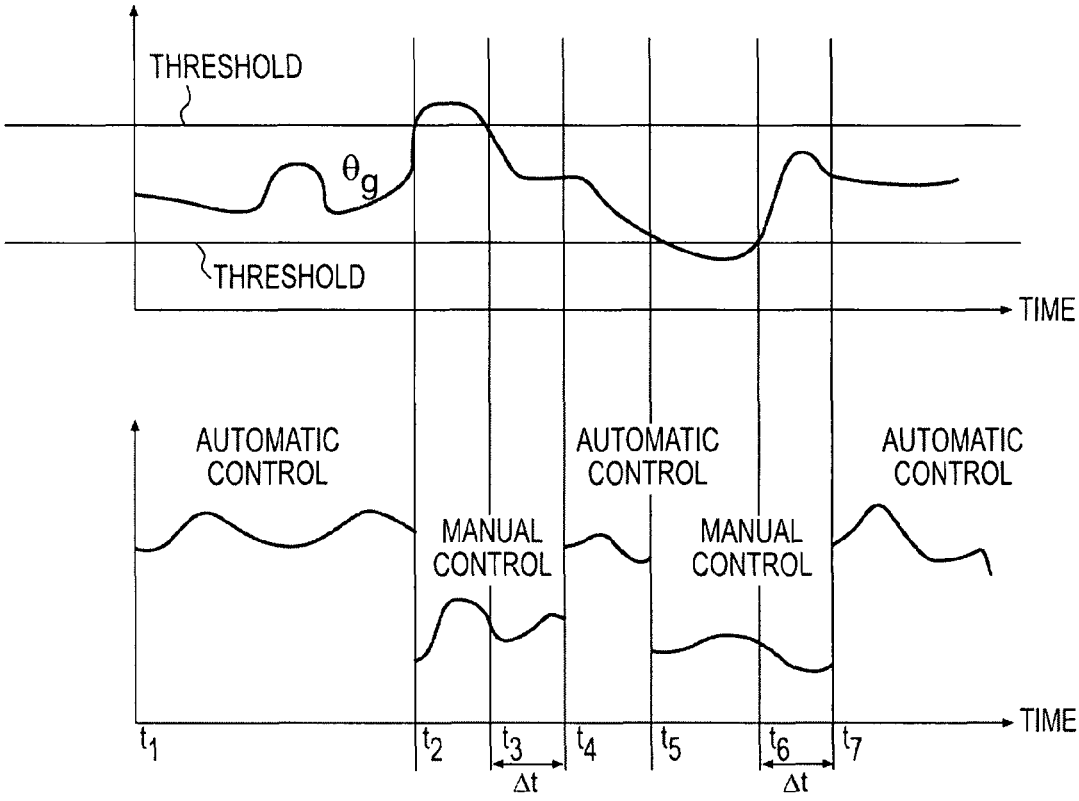
FIG. 5 is a graphical representation of an exemplary blade control strategy.

As disclosed in FIG. 5, when the absolute value of machine roll angle $\theta_m$ is greater than a predetermined roll threshold, controller 76 may determine that a potential malfunction may occur such as, for example, machine 10 tipping over. Controller 76 may not be able to automatically resolve such a potential malfunction and may cede slope angle control to the operator by switching to a manual mode. It should be understood that the predetermined roll threshold may be a magnitude of an angle, or any other value capable of preventing machine 10 from tipping over. The operator may retain manual control over slope angle $\theta$ until the absolute value of machine roll angle $\theta_m$ is at or below the predetermined threshold for a predetermined period of time, which may be tracked by time tracking device 78. When the absolute value of machine roll angle $\theta_m$ is at or below the predetermined roll threshold for at least the predetermined period of time, controller 76 may switch to an automatic mode and assume control over slope angle $\theta$.

Figure 6:
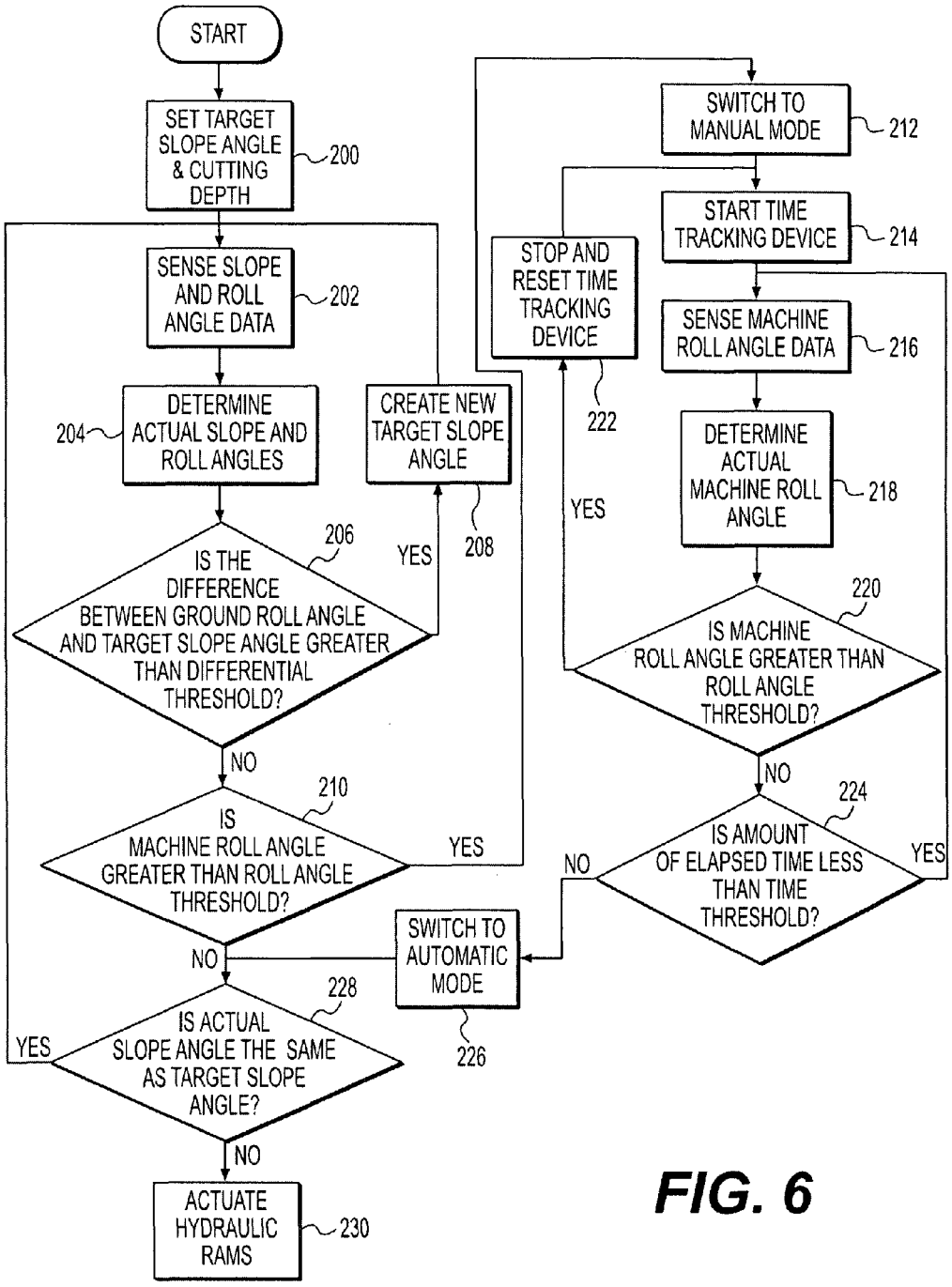
FIG. 6 is a flow diagram of an exemplary disclosed method for moving a blade of the motor grader of FIG. 1.

FIG. 6, which is discussed in the following section, illustrates the operation of machine 10 utilizing embodiments of the disclosed system. In particular, FIG. 6 illustrates an exemplary method used to maintain a desired slope angle and cutting depth of blade 52.

INDUSTRIAL APPLICABILITY

The disclosed system may autonomously control a slope angle of a tool on a mobile machine and alleviate the operator from some tool control responsibilities. In particular, the disclosed system may be configured to autonomously detect potential malfunctions related to the slope angle of the tool and take action to prevent such errors. For example, when the desired cutting plane of the tool is deep enough to cause the mobile machine to stall, a controller may modify the desired cutting plane and prevent the mobile machine from stalling. Furthermore, when the angle at which the mobile machine is operating becomes too steep for the controller to adequately control the tool and/or mobile machine, the controller may cede control of the slope angle of the tool to the operator. The operation of blade positioning system 24 will now be explained.

FIG. 6 illustrates a flow diagram depicting an exemplary method for automatically controlling a slope angle θ and cutting depth d of blade 52. The method may begin by selecting a target slope angle $\theta_t$ and target cutting depth $d_t$ for blade 52 (step 200). The selection may be performed by an operator. In particular, the operator may actuate a device on user interface 62 or 66, such as, for example, a button, touch screen, knob, joystick, switch, or other device capable of sending a selection signal to controller 76. Alternately, target slope angle $\theta_t$ and target cutting depth $d_t$ may be made by a computing device such as, for example, controller 76, another separate controller, or a computer. The computing device may make the selection by referencing charts, tables, or algorithms stored in the computing device.

After selecting the target slope angle $\theta_t$, target cutting depth $d_t$ controller 76 may receive signals from cylinder position sensors 68, articulation sensor 70, link bar sensor 72, and grade detector 74 (step 202). Controller 76 may compare the data received from cylinder position sensors 68, articulation sensor 70, link bar detector 72, and grade detector 74 to maps, charts, algorithms, etc. stored in controller 76 to determine a current slope angle θ of blade 52, machine roll angle $\theta_m$, and ground roll angle $\theta_g$ (step 204).

Upon determining the current ground roll angle $\theta_g$, controller 76 may calculate the difference between the current ground roll angle $\theta_g$ and target slope angle $\theta_t$ and compare the absolute value of the resulting difference to a predetermined differential threshold (step 206). The predetermined differential threshold may be any value above which, machine 10 may be likely to stall. In addition, the predetermined differential threshold may be based on any number of factors such as, for example, engine strength, the geometry of machine 10, geometry of blade 52, and/or any other factor that may contribute to machine 10 stalling. If controller 76 determines that the absolute value of the difference between ground roll angle $\theta_g$ and target slope angle $\theta_t$ is greater than the predetermined differential threshold (step 206: Yes), controller 76 may create a new target slope angle $\theta_t$ (step 208). The new target slope angle $\theta_t$ may be less than the previous target slope angle $\theta_t$. Once a new target slope angle $\theta_t$ has been selected, step 202 may be repeated (i.e. controller 76 may receive new signals from cylinder position sensors 68, articulation sensor 70, link bar sensor 72, and grade detector 74).

If controller 76 determines that the absolute value of the difference between ground roll angle $\theta_g$ and target slope angle $\theta_t$ is less than the predetermined differential threshold (step 206: No), controller 76 may compare machine roll angle $\theta_m$ to a predetermined roll angle threshold (step 210). The predetermined roll angle threshold may represent an angle above which machine 10 may be caused to tip over. In addition, the predetermined roll angle threshold may be based on any number of factors such as, for example, the geometry of machine 10, geometry of blade 52, and/or any other factor that may contribute to machine 10 tipping over on its side. If controller 76 determines that machine roll angle $\theta_m$ greater than the predetermined roll angle threshold (step 210: Yes), controller 76 may switch to a manual mode in which the operator may control slope angle θ of blade 52 (step 212). However, if controller 76 determines that machine roll angle $\theta_m$ less than the predetermined roll angle threshold (step 210: No), controller may compare the actual slope angle θ to target slope angle $\theta_t$ (step 228). The performance of step 228 will be further explained later.

While in the manual mode, controller 76 may actuate time tracking device 78 to monitor the amount of time that elapses (step 214). Once controller 76 actuates time tracking device 78, new signals may be received from grade detector 74 (step 216). Controller 76 may compare the data received from grade detector 74 to maps, charts, algorithms, etc. stored in controller 76 to determine the current machine roll angle $\theta_m$ (step 218). Upon determining the current machine roll angle $\theta_m$, controller 76 may compare the absolute value of the current machine roll angle $\theta_m$ to the above-mentioned predetermined roll angle threshold (step 220). If controller 76 determines that the absolute value of machine roll angle $\theta_m$ is greater than the predetermined roll angle threshold (step 220: Yes), controller 76 may stop and reset time tracking device 78 (step 222). Once the time tracking device is reset, step 214 may be repeated (i.e. controller 76 may begin tracking time).

If controller 76 determines that the absolute value of machine roll angle $\theta_m$ is less than the predetermined roll angle threshold (step 220: No), controller 76 may compare the amount of time that has elapsed and determine whether the amount of time that has elapsed is less than a predetermined time threshold (step 224). If the elapsed time is less than the predetermined time threshold (step 224: Yes), then step 216 may be repeated (i.e. controller 76 may receive new signals from grade detector 74). However, if the elapsed time is equal to or greater than the predetermined time threshold (step 224: No), controller 76 may switch back to an automatic mode and assume control of slope angle θ (step 226).

Either after switching back from manual mode or upon determining that machine roll angle $\theta_m$ is less than the predetermined roll angle threshold (step 210: No), controller 76 may determine if the actual slope angle θ of blade 52 is essentially equal to target slope angle $\theta_t$ (step 228). If controller 76 determines that the actual slope angle θ of blade 52 is essentially equal to target slope angle $\theta_t$, step 202 may be repeated (i.e. controller 76 may receive new signals from cylinder position sensors 68, articulation sensor 70, link bar sensor 72, and grade detector 74). However, if controller 76 determines that the actual slope angle θ of blade 52 is not essentially equal to target slope angle $\theta_t$, controller 76 may actuate hydraulic rams 32 and 34 to move blade 52 into its desired position and orientation (step 230). Upon actuating hydraulic rams 32 and 34, step 202 may be repeated (i.e. controller 76 may receive new signals from cylinder position sensors 68, articulation sensor 70, link bar sensor 72, and grade detector 74).

It should be understood that the disclosed method may continue indefinitely until it is stopped by the operator. The automatic blade positioning operation may be terminated at any step in the method. Furthermore, the operator may terminate the operation by actuating a device on user interface 62 or 66, such as, for example, a button, touch screen, knob, switch, or other device capable of sending a termination signal to controller 76.

By considering the depth of the cutting plane and the inclination of the machine, the disclosed blade control system may anticipate potential cutting-related malfunctions and take corrective action to prevent such malfunctions. This may free the operator to devote his limited resources to other tasks required for the proper operation of the machine. If the cutting plane of the blade is too deep, the control system may automatically adjust the plane so that the machine does not stall. In addition, if the inclination of the machine is too steep, the control system may relinquish control of the blade to the operator to prevent the machine from tipping over and causing injury or damage to the machine.

It will be apparent to those skilled in the art that various modifications and variations can be made in the disclosed system without departing from the scope of the disclosure. Other embodiments will be apparent to those skilled in the art from consideration of the specification disclosed herein. It is intended that the specification and examples be considered as exemplary only, with a true scope being indicated by the following claims and their equivalents.

What is claimed is:

1. A work implement positioning system for positioning a work implement of a machine that includes a power source, the system comprising:

at least one actuator for actuating a movement of the work implement;

at least one sensor associated with the at least one actuator and configured to sense at least one parameter indicative of an orientation and a position of the work implement;

at least one ground inclination sensor configured to sense a parameter indicative of an inclination of a surface of the ground; and a controller configured to automatically adjust the orientation and position of the work implement, in response to data received from the at least one sensor and the at least one ground inclination sensor, when the controller determines penetration of the surface of the ground with the work implement at its current orientation or position will stall the power source.

2. The work implement positioning system of claim 1, wherein the controller is further configured to create a target work implement position and orientation and adjust the position and orientation of the work implement to essentially match the target work implement position and orientation.

3. The work implement positioning system of claim 2, wherein the controller is further configured to determine that penetration of the surface of the ground will stall the power source based on the target work implement position and orientation and data received from the ground inclination sensor.

4. The work implement positioning system of claim 3, wherein the controller is further configured to adjust the target work implement position and orientation.

5. The work implement positioning system of claim 4, wherein the orientation of the work implement is an inclination of the work implement.

6. The work implement positioning system of claim 5, wherein the controller is further configured to determine that penetration of the surface of the ground will stall the power source when a difference between the work implement inclination and the ground inclination exceeds a predetermined threshold.

7. A method for moving and orienting a work implement of a machine that includes a controller, comprising:

sensing at least one parameter indicative of an orientation and a position of a work implement;

sensing at least one parameter indicative of an inclination of the ground; and automatically modifying with the controller the orientation of the work implement in response to the sensed orientation and position of the work implement and the inclination of the ground, when the controller determines attempted penetration of the ground to a desired depth with the work implement will result in the machine tipping over.

8. The method of claim 7, further including creating a target work implement orientation and position and adjusting the orientation and position of the work implement to essentially match the target work implement orientation and position.

9. The method of claim 8, further including adjusting the target work implement orientation in response to the determination that attempted penetration of the ground to the desired depth will result in the machine tipping over.

10. The method of claim 9, wherein the determination that attempted penetration of the ground to the desired depth will result in the machine tipping over is based on the sensed inclination of the ground and the target work implement orientation.

11. The method of claim 7, further including sensing at least one parameter indicative of a machine inclination.

12. The method of claim 11, further including switching to a manual mode when the sensed machine inclination exceeds a predetermined threshold.

13. The method of claim 12, further including switching from a manual mode to an automatic mode when the sensed machine inclination is less than the predetermined threshold for a predetermined period of time.

14. A machine, comprising:

at least one traction device;

a power source;

a work implement;

at least one actuator for actuating a movement of the work implement;

at least one sensor associated with the at least one actuator and configured to sense at least one parameter indicative of an angular orientation and a position of the work implement, the angular orientation corresponding to a difference in height of ends of a blade of the work implement;

at least one ground inclination sensor configured to sense a parameter indicative of an inclination of a surface of the ground; and a controller configured to automatically adjust the angular orientation and position of the work implement in response to data received from the at least one sensor and the at least one ground inclination sensor, when the controller determines either that penetration of the surface of the ground with the work implement at its current orientation or position will stall the power source or that penetration of the ground to a desired depth with the work implement will result in the machine tipping over.

15. The machine of claim 14, wherein the controller is further configured to create a target work implement position and angular orientation and adjust the position and angular orientation of the work implement to essentially match the target work implement position and angular orientation.

16. The machine of claim 15, wherein the controller is further configured to determine either that penetration of the surface of the ground will stall the power source or that penetration of the ground to the desired depth will result in the machine tipping over based on the target work implement position and angular orientation and data received from the ground inclination sensor.

17. The machine of claim 16, wherein the controller is further configured to adjust the target work implement position and angular orientation when determining the potential work implement malfunction.

18. The machine of claim 17, further including at least one machine inclination sensor configured to sense a parameter indicative of an inclination of the machine.

19. The machine of claim 18, wherein the controller is further configured to switch to a manual mode when the inclination of the machine exceeds a predetermined threshold.

20. The machine of claim 19, wherein the controller is further configured to switch from a manual mode to an automatic mode when the inclination of the machine is less than a predetermined threshold for a predetermined period of time.

* * * * *

UNITED STATES PATENT AND TRADEMARK OFFICE

CERTIFICATE OF CORRECTION

PATENT NO. : 8,103,417 B2
APPLICATION NO. : 11/896393
DATED : January 24, 2012
INVENTOR(S) : Gharsalli et al.

It is certified that error appears in the above-identified patent and that said Letters Patent is hereby corrected as shown below:

In the Claims

Column 9, line 65, in Claim 7, delete "implement in" and insert -- implement, in --.

Column 10, line 44, in Claim 14, delete "implement in" and insert -- implement, in --.

Signed and Sealed this
Eighteenth Day of August, 2015

Michelle K. Lee

Michelle K. Lee
*Director of the United States Patent and Trademark Office*